US007358713B2

(12) United States Patent
Hauser

(10) Patent No.: US 7,358,713 B2
(45) Date of Patent: Apr. 15, 2008

(54) CONSTANT VOLTAGE SOURCE WITH OUTPUT CURRENT LIMITATION

(75) Inventor: Clemens Hauser, Heilbronn (DE)

(73) Assignee: ATMEL Germany GmbH, Heilbronn (DE)

( * ) Notice: Subject to any disclaimer, the term of this patent is extended or adjusted under 35 U.S.C. 154(b) by 0 days.

(21) Appl. No.: 11/637,749

(22) Filed: Dec. 13, 2006

(65) Prior Publication Data

US 2007/0132441 A1 Jun. 14, 2007

(30) Foreign Application Priority Data

Dec. 13, 2005 (DE) ..... 10 2006 061 377

(51) Int. Cl.
*G05F 1/16* (2006.01)

(52) U.S. Cl. ..... 323/316; 323/314; 323/277

(58) Field of Classification Search ..... 323/313, 323/314, 315, 316, 276, 277, 280
See application file for complete search history.

(56) References Cited

U.S. PATENT DOCUMENTS 6,054,845 A * 4/2000 Feldtkeller ..... 323/277
6,407,537 B2 6/2002 Antheunis
6,861,832 B2 * 3/2005 Perez ..... 323/316
7,129,683 B2 10/2006 Haider et al.

FOREIGN PATENT DOCUMENTS

DE 103 32 864 A1 2/2005
WO WO 01/46768 A1 6/2001

OTHER PUBLICATIONS

Tietze et al., "Halbleiterschaltungstechnik," 9th edition, Springer-Verlag Berlin Heidelberg New York, ISBN 3-540-19475-4, pp. 544-545.

* cited by examiner

*Primary Examiner*—Jessica Han
(74) *Attorney, Agent, or Firm*—Muncy, Geissler, Olds & Lowe, PLLC

(57) ABSTRACT

A constant voltage source is disclosed having an output current control element, which adjusts an output voltage of the constant voltage source by varying its output current, a control circuit, which acquires a measure for an actual value of the output voltage and processes it to a control signal for the control of the output current control element, and a limiting circuit, which limits the output current to a predefined maximum value by action on the control signal, whereby the limitation is independent of an actual value of the output current. Wherein the limiting circuit has a first pair comprising a first transistor and a second transistor and a second pair comprising a third transistor and a fourth transistor, whereby the first and fourth transistor belong to a first conductivity type, the second and third transistor belong to a second conductivity type, operating current paths of the first pair lie in series between a reference current source and a supply potential, the operating current paths of the second pair are integrated in series into the control branch, control terminals of transistors of the same type are connected to one another, control terminals of transistors of the first conductivity type are connected to the reference current source, and control terminals of transistors of the second conductivity type to a first voltage source. Further, a method for generating a load-independent constant output voltage is disclosed.

10 Claims, 4 Drawing Sheets

CONSTANT VOLTAGE SOURCE WITH OUTPUT CURRENT LIMITATION

This nonprovisional application claims priority under 35 U.S.C. § 119(a) on German Patent Application No. DE 102005061377, which was filed in Germany on Dec. 13, 2005, and which is herein incorporated by reference.

BACKGROUND OF THE INVENTION

1. Field of the Invention

The present invention relates to a constant voltage source with an output current control element, which adjusts an output voltage (u_out) of the constant voltage source by varying its output current, with a control circuit, which determines an actual value of the output voltage and processes it to a control signal for controlling the output current control element, and with a limiting circuit, which limits the output current to a predefined maximum value by action on the control signal. Furthermore, the invention relates to a method for generating a load-independent constant output voltage with such a constant voltage source.

2. Description of the Background Art

A constant voltage source is known from the publication "Halbleiterschaltungstechnik" (Semiconductor Circuit Technology) by Tietze and Schenk, ISBN 3-540-19475-4, 9th edition, Springer-Verlag Berlin Heidelberg New York, pages 544, 545, there in particular FIG. 18.11.

This figure shows an integrated voltage regulator with a power transistor, which outputs a variable output current, to provide a constant voltage. A first subcircuit, which has a resistive voltage divider and a differential amplifier, compares an actual value for the voltage with a reference value. An output signal of the differential amplifier represents a measure for the indicated deviation and is used to control the power transistor in a first feedback loop.

To limit the output current, the prior-art circuit has a current shunt in the output current branch and a second transistor, which in the conductive state reduces a control voltage of the power transistor. An excessively large voltage drop across the current shunt, which is generated by a too high output current, activates the second transistor and thereby reduces the control signal of the power transistor. The output current limitation in the prior-art circuit therefore occurs in a second feedback loop. The prior-art circuit has an undesirable oscillation tendency and must therefore be stabilized by additional measures.

WO 01/46768 A1, which corresponds to U.S. Pat. No. 6,407,537 also discloses a constant voltage source.

A disadvantage of the prior art is that due to the effect of the channel length modulation, the maximum value of the output current depends on the input or supply voltage. A further disadvantage is that the prior-art constant voltage source does not permit a higher input or supply voltage, because in this case a transistor would break down.

SUMMARY OF THE INVENTION

It is therefore an object of the present invention to provide a constant voltage source, which has a reduced oscillation tendency, manages without a precision resistor, enables higher input or supply voltages, and exhibits no dependence of the maximum value of the output current on the input or supply voltage.

The second feedback no longer applies at all due to the control signal limitation which is independent of the actual value of the output current. It turned out that the oscillation tendency of the array declines considerably as a result. Fields of application for the invention occur wherever a short-circuit-proof voltage supply is necessary, particularly in applications in which the input voltage (the supply potential) is just above the output voltage ("low drop out" voltage supply). A typical application is, for example, the supplying of an ABS Hall sensor (wheel speed sensor) in a vehicle. Cell phones are another typical field of application.

The constant voltage source of the invention permits limitation of the control current in the control branch to a maximum value, which can be established by selecting the reference current, which is output by the reference current source, and image ratio of the two transistor pairs.

In the case of field-effect transistors, advantageously virtually no channel length modulation occurs or in the case of bipolar transistors no Early effect, so that the maximum value of the output current does not depend on the input or supply voltage.

In addition, the series connection of the transistors of the first pair and the transistors of the second pair advantageously make it possible to use higher input or supply voltages.

An embodiment of the constant voltage source includes a control current branch with a transistor diode, which forms a current mirror with an output transistor as the output current control element, whereby a control current generated by the control circuit flows as a control signal in the control current branch.

In the prior-art circuit, the output signal of a differential amplifier is used directly for controlling an output current-power transistor, as a result of which undesirable reactions by the power transistor to the control signal are possible. These undesirable reactions are avoided or at least reduced by the use of the current mirror, which has a high output resistance.

Also, the control circuit can have a voltage divider, which is connected to the output current control element and can have a center tap.

This type of voltage divider permits acquisition of a measure for the output voltage as an actual value input parameter for regulating the output current.

Furthermore, the control circuit can have a differential amplifier with a first input and a second input, whereby the first input is connected to a second voltage source as a reference voltage source and the second input to the center tap.

A difference between the actual value input parameter and the voltage provided by the second voltage source is generated by said differential amplifier. The difference is suitable as a control deviation for regulating the current intensity of the output current.

In another embodiment, the control circuit can have a fifth transistor, whose operating current path is integrated into the control branch and whose control terminal is connected to an output of the differential amplifier.

The fifth transistor determines the control current intensity as a function of the control deviation within the limits set by the limiting circuit.

The transistors and transistor diodes can be realized using CMOS technology. Furthermore, the transistors of the first conductivity type are PMOS transistors and the transistors of the second conductivity type are NMOS transistors. Alternatively, the transistors and transistor diodes, however, may also be realized using bipolar technology, whereby the transistors of the first conductivity type are PNP transistors and the transistors of the second conductivity type are NPN transistors.

The second and the third transistors can be made as high-blocking transistors. As a result, higher input or supply voltages can be used advantageously.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1A:
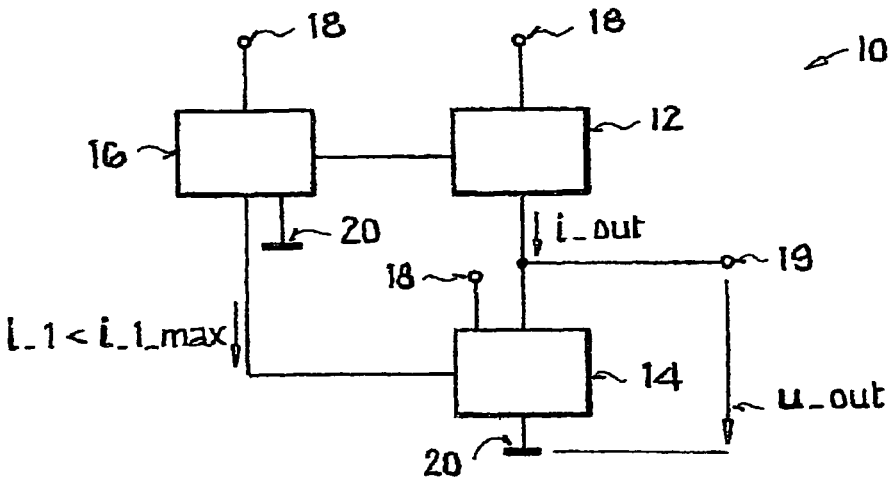
FIGS. 1*a* and 1*b* illustrate a constant voltage source according to an embodiment of the present invention.

FIG. 1*a* shows in detail a constant voltage source 10 with an output current control element 12, a control circuit 14, and a limiting circuit 16. Constant voltage source 10 has supply potential terminals 18 and a reference potential terminal 20. Output current control element 12 outputs an output current i_out, which in the diagram of FIG. 1 flows across the control circuit 14 to reference potential 20. In this case, a voltage u_out drops across control circuit 14, which can be removed at an output voltage terminal 19. If a consumer is connected to output voltage terminal 19 and reference potential terminal 20, output current i_out divides into a partial current through the control circuit and a partial current through the consumer. To keep the output voltage constant at output voltage terminal 19, the partial current through control circuit 14 must generate substantially the same voltage drop there as without a connected consumer. To this end, output current i_out should be accordingly increased overall.

For this purpose, control circuit 14 acquires a measure for an actual value of output voltage u_out, compares this actual value with a target value, and produces control signal i_1 dependent on this comparison. This control signal i_1 prompts output current control element 12 to an appropriate increase in output current i_out. In the steady state, the output voltage at output voltage terminal 19 with a connected consumer then corresponds to the value without a connected consumer. Changes in the resistance of a connected consumer, which, e.g., are caused by temperature changes, are compensated in a similar way. In this case, constant voltage source 10 sets the higher an output current i_out, the lower the resistance of a connected consumer. With very low resistances of the consumer, for example, with a short circuit of the consumer, there is the risk of a deterioration of output current control element 12 by too high values of output current i_out. To avoid such unallowably high values of output current i_out, limiting circuit 16 limits control signal i_1 to a predefined maximum value i_1_max. It is essential here that the limiting of control signal i_1 occurs independent of an actual value of the output current i_out.

Figure 1B:
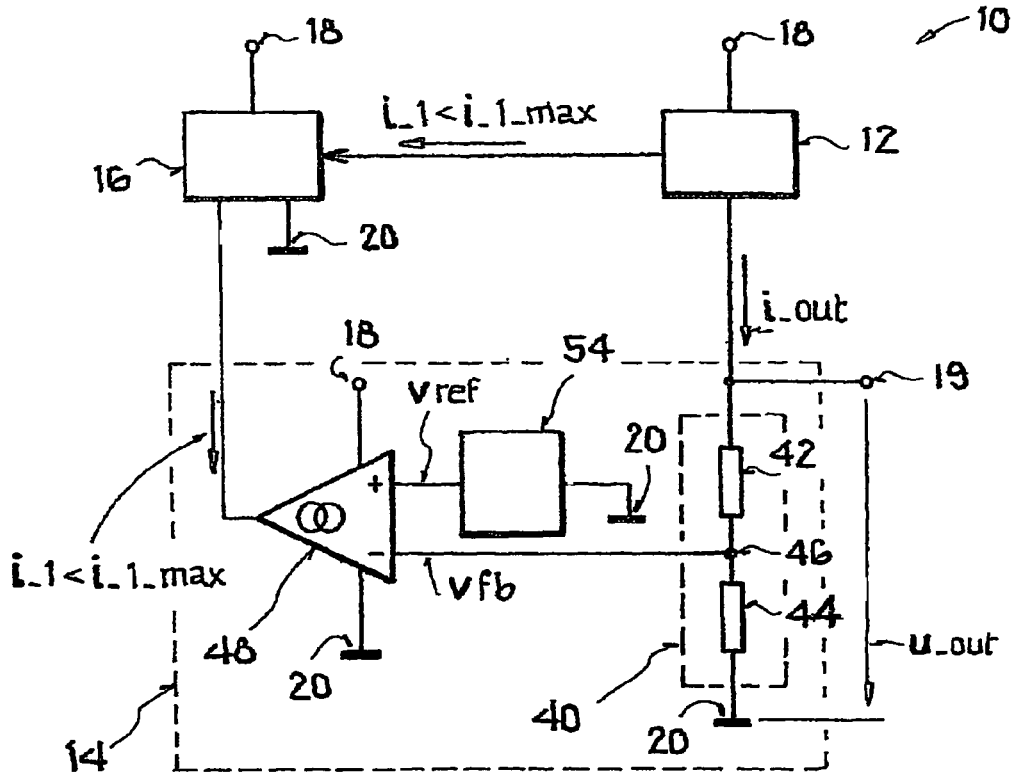

FIG. 1*b* shows in addition an embodiment of control circuit 14. Control circuit 14 has a voltage divider 40 comprising two resistors 42 and 44. Voltage divider 40 is connected to output current control element 12 and has a center tap 46. A voltage vfb arising at center tap 46 is compared by a differential amplifier 48 with a reference voltage vref. Depending on the comparison, the differential amplifier produces a control current i_1 as a control signal. Control current i_1 is limited by limiting circuit 16 to a maximum value i_1_max.

Figure 2:
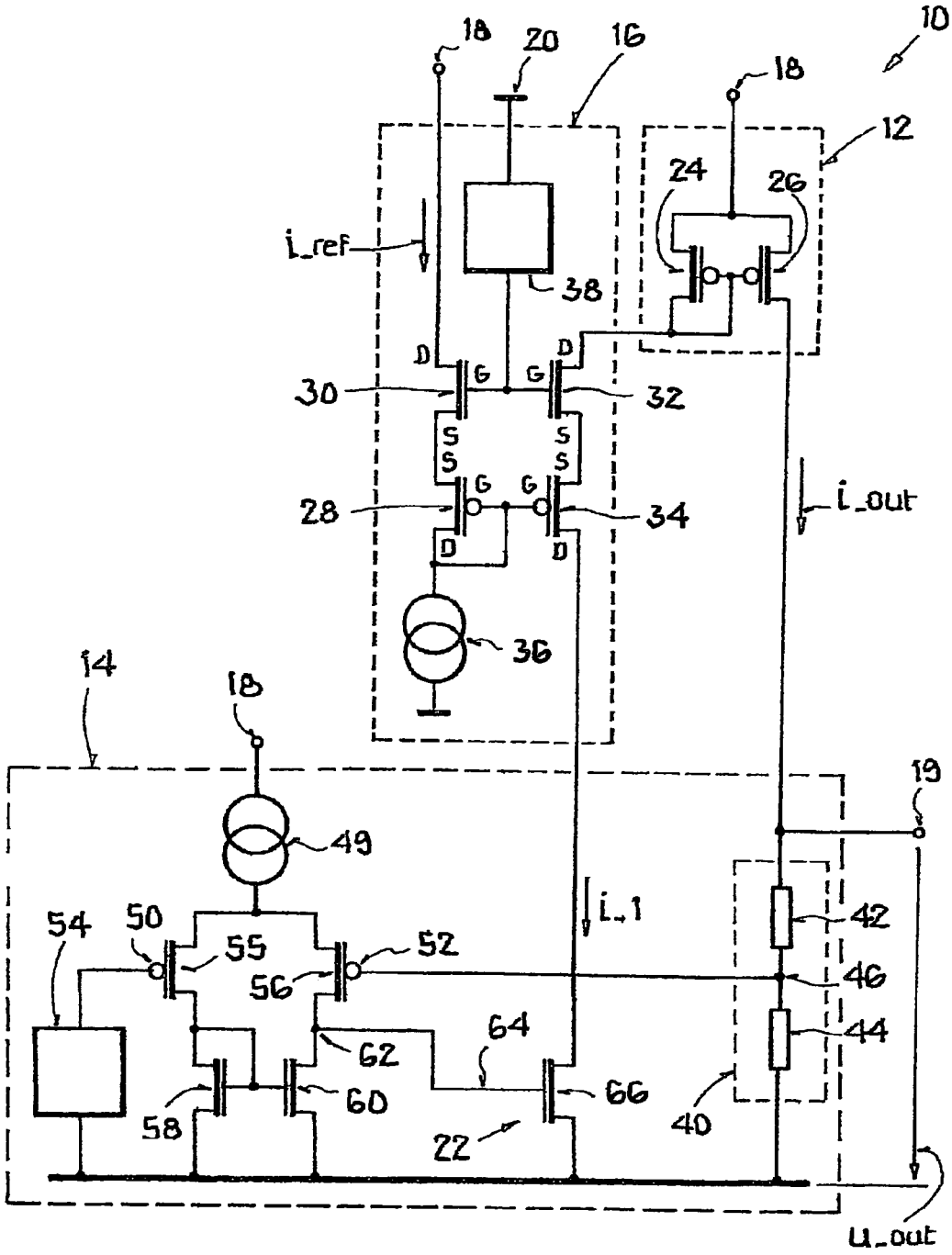
FIG. 2 illustrates an embodiment of FIG. 1.

FIG. 2 shows an embodiment, defined more specifically in terms of circuitry, of a constant voltage source 10. This embodiment includes a control current branch 22, in which a control current i_1, controlled by control circuit 14, flows as a control signal. Control current branch 22 is connected both to output current control element 12 and to control circuit 14 and limiting circuit 16. Thus, output current control element 12 in the embodiment of FIG. 2 has a current mirror with PMOS transistor diode 24 and a PMOS output transistor 26 through which control current i_1 flows. Output current i_out arises accordingly as the product of control current l_1 with a factor that is predetermined by the dimensioning of transistors 24 and 26.

Limiting circuit 16 has in particular a first pair comprising a first transistor 28 and a second transistor 30 and a second pair comprising a third transistor 32 and a fourth transistor 34. In this case, operating current paths of the second pair are integrated in series in control branch 22, so that control current i_1 flows through them and they can influence it accordingly by changing their conductance. In other respects, first transistor 28 and fourth transistor 34 belong to a first conductivity type, whereas second transistor 30 and third transistor 32 belong to a second conductivity type. In the embodiment of FIG. 2, the transistors of the first conductivity type are PMOS transistors and the transistors of the second conductivity type NMOS transistors.

The control terminals G of first transistor 28 and of fourth transistor 34 are connected to one another and to a reference current source 36. Reference current source 36 is moreover connected to a drain terminal D of first transistor 28. Operating current paths of first transistor 28 and of second transistor 30 are connected in series and connected via a drain terminal D of second transistor 30 to supply potential terminal 18. A reference current i_ref therefore flows through the operating current paths of first transistor 28 and second transistor 30. Gate-source voltages U_GS of transistors 28 and 30 are established by the value of reference current i_ref. Here, each letter S in FIG. 2 designates source terminals of transistors 28, 30, 32, and 34. This also establishes the gate potentials at third transistor 32 and fourth transistor 34. The gate potential of third transistor 32 corresponds to the gate potential of second transistor 30 and the gate potential of fourth transistor 34 corresponds to the gate potential of first transistor 28.

As will be shown further below, this array has a current-limiting effect because of the fixed gate potentials. In the following text, however, the control action will be explained first, by which circuit 10 maintains output voltage u_out.

To control output current control element 12, constant voltage source 10 according to FIG. 2 has a voltage divider 40 comprising two resistors 42 and 44. Voltage divider 40 is connected to output current control element 12 and has a center tap 46. The control circuit furthermore has a differential amplifier 48 with a constant current source 49, a first input 50, and a second input 52. First input 50 is connected to a second voltage source 54, whereas second input 52 is connected to center tap 46 of voltage divider 40. In the embodiment of FIG. 2, first input 50 is a gate terminal of a PMOS transistor 55. Similarly, second input 52 is designed as a gate terminal of a PMOS transistor 56. Differential amplifier 48 furthermore has an NMOS transistor 58, which is connected as a transistor diode and is disposed between PMOS transistor 55 and a reference potential terminal 20. The gate terminal of NMOS transistor 58 is connected to the gate terminal of another NMOS transistor 60, which is disposed between PMOS transistor 56 and reference potential terminal 20.

At output 62 of differential amplifier 48, a potential then arises, which depends on the difference of the potentials at first input 50 and second input 52 and thereby on output voltage u_out. Output 62 is connected to a control terminal 64 of an NMOS transistor 66, whose operating current path is integrated into control branch 22 and which therefore connects control circuit 14 to control branch 22. In the steady state, a control current i_1 flows in control current branch 22; after this current is converted by the current mirror in output current control element 12 into an output current i_out, it leads to a voltage u_out at output voltage terminal 19.

If the voltage u_out then rises due to changes in the resistance of a connected consumer, the potential at center tap 46 and at second input 52 of differential amplifier 48 therefore also increases. Because transistor 56 is realized as a PMOS transistor, its conductivity then declines, so that the potential at output 62 of differential amplifier 48 declines. Then, the conductivity of fifth transistor 66 also declines, which leads to a decrease in control current i_1 and thereby to a smaller output current i_out and thereby to a decline in the voltage u_out. The control current i_1 increases accordingly due to the effect of control circuit 14, when the output voltage u_out declines.

Limiting circuit 16 thereby prevents that control current i_1 rises to values at which output current control element 12 would be damaged by a too high output current i_out. The principle of limitation will be explained hereafter.

Transistors 24, 32, 34, and 66 form control branch 22 and lie in series between the supply potential at terminal 18 and the reference potential at terminal 20. At a constant i_out<i_out_max, the current i_1 in control branch 22 is constant as well. When the gate potential of NMOS control transistor 66 increases because of a declining output voltage u_out, it first reduces the resistance of control branch 22, so that the current i_1 in the control branch increases. The increasing current i_1 leads to increasing voltage drops, therefore to increasing drain-source voltages, at transistors 24, 32, and 34. This leads in particular to a decline, albeit slight, in the source potential at transistors 32 and 34. The gate potentials of transistors 32 and 34, on the contrary, remain constant, because they are fixedly set by the left branch of limiting circuit 16. The sum of the two gate-source potentials of transistors 32 and 34 is established by transistors 28 and 30 and can therefore not change. At most a slight shift in the source voltage of transistors 32 and 34 can occur, as long as i_1<i_max. This means that the gate-source voltage of transistor 32 increases by a certain amount, whereas the gate-source voltage of transistor 34 decreases by the same amount.

Figure 3A:
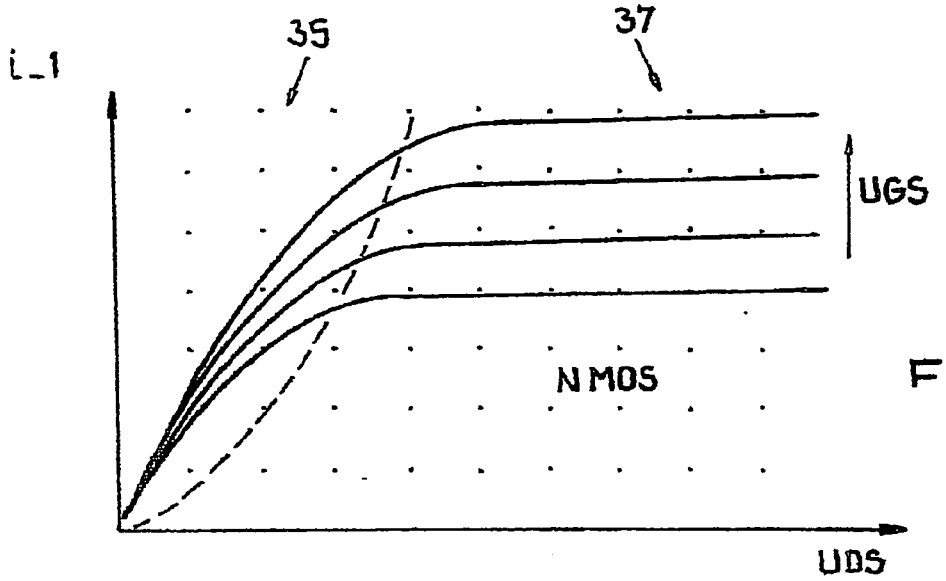
FIG. 3 illustrates one output characteristic field each for an NMOS and a PMOS transistor.
Figure 3B:
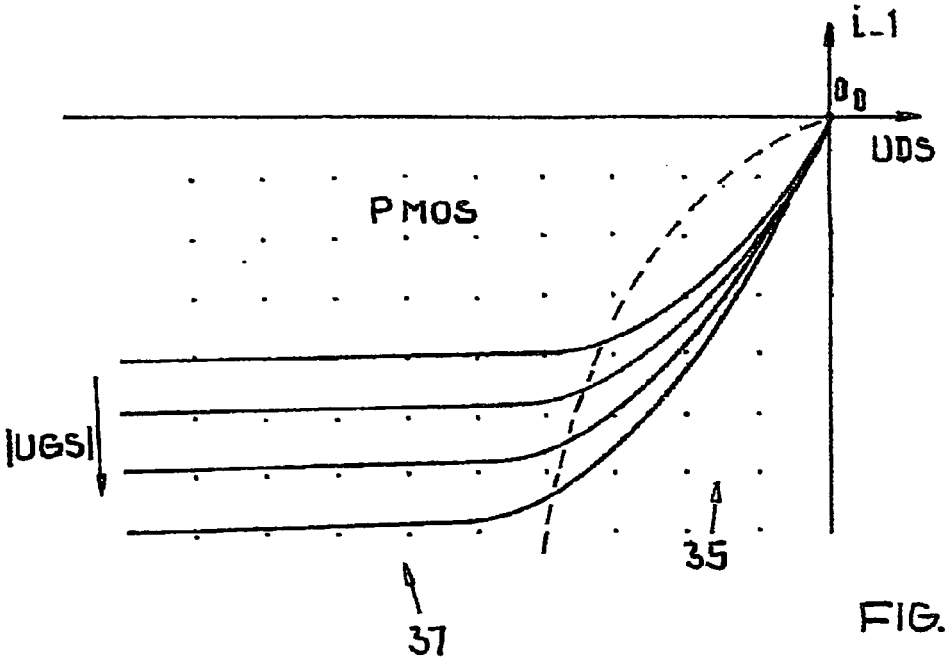

In sum, thereby, the operating points of transistors 32 and 34 change in regard to their respective output characteristic field. FIG. 3*a* shows this type of output characteristic field for an NMOS transistor and FIG. 3*b* shows an output characteristic field for a PMOS transistor. Both characteristic diagrams each show the courses of the drain current i_1 versus the drain-source voltage UDS with the gate-source voltage UGS as the parameter.

In the two transistors 32, 34, the absolute amount of the drain current rises in principle with gate-source voltages increasing amount-wise and with drain-source voltages increasing amount-wise.

There is only one transistor diode 24 between NMOS transistor 32 and supply potential terminal 18. Because of its exponential characteristic, transistor diode 24 provides considerable current changes with small changes in the voltage drop across the diode. Therefore, the drain potential of NMOS transistor 32 changes only slightly with changes in the current I_1. An increase in the drain current I_1 of NMOS transistor 32 is therefore dominated by the decrease in its source potential at a constant gate potential. Because of the increase in its gate-source voltage, NMOS transistor 32 can also be operated at saturation, therefore, in part 37 of its characteristic field, without drain current changes leading to considerable changes in its drain-source voltage.

However, in PMOS transistor 34, the same drain current rise results as a difference of contributions, which are provided via a drain-source voltage increase and via a gate-source voltage drop. This suggests in particular that the rise in the drain-source voltage must be relatively great.

In other words, changes in the current I_1 lead to relatively small changes in the drain-source voltage of NMOS transistor 32, but to relatively great changes in the drain-source voltage of PMOS transistor 34. PMOS transistor 34 in the right branch of limiting circuit 16 therefore functions like a current-dependent resistor. If only a small output current i_out is required, then it works in the linear region 35 of its output characteristic field, which is shown in FIG. 3. Its output resistance is small in comparison with the output resistance of the control transistor 66 which is driven by differential amplifier 48 and at which in this case the greater part of the supply voltage drops. The drain-source voltage of PMOS transistor 34 is virtually zero. This would be a point at the top right in the output characteristic field of FIG. 3*b*. If the output current i_out now rises, the output resistance of control transistor 66 decreases due to the action of differential amplifier 48, whereas simultaneously the output resistance of right PMOS transistor 34 in limiting circuit 16 rises. The current through the right side of limiting circuit approaches more and more the current flow on the left side. With suitable scaling of the transistors on the right side, this can also be a multiple of the current on the left side. With an increasing drain current i_1, right PMOS transistor 34 enters region 37 of the current saturation. Its maximum gate-source voltage is fixedly established by the left part of limiting circuit 16 and cannot increase. Here, its output resistance rises greatly with an increasing drain-source voltage.

Control transistor 66, driven by differential amplifier 48, now enters the linear region, because its output current cannot increase further despite the large gate-source voltage. The majority of the output voltage now drops across right PMOS transistor 34 of the limiting circuit. The corresponding drain-source voltage UDS grows considerably with an increasing drain current i_1, whereas UGS varies only slightly. In FIG. 3*b*, such behavior corresponds to the course of a single characteristic from the shown family of characteristics. The flat characteristic course in the saturation region 37 produces the desired limiting effect.

Because the source potential of fourth transistor 34 is constantly kept at a low value and thereby variation of the drain potential in this transistor is low and virtually does not depend on the supply potential at terminal 18, practically no notable channel length modulation occurs advantageously in constant voltage source 10 in the case of field-effect transistors, or no Early effect in the case of bipolar transistors.

In another embodiment, second transistor 30 and third transistor 32 are each made as high-blocking transistors. Because of the series connection of transistors 28, 30 and the series connection of transistors 32, 34, therefore advantageously higher input or supply voltages can be applied at circuit node 18, without risking a transistor breakdown.

Figure 4:
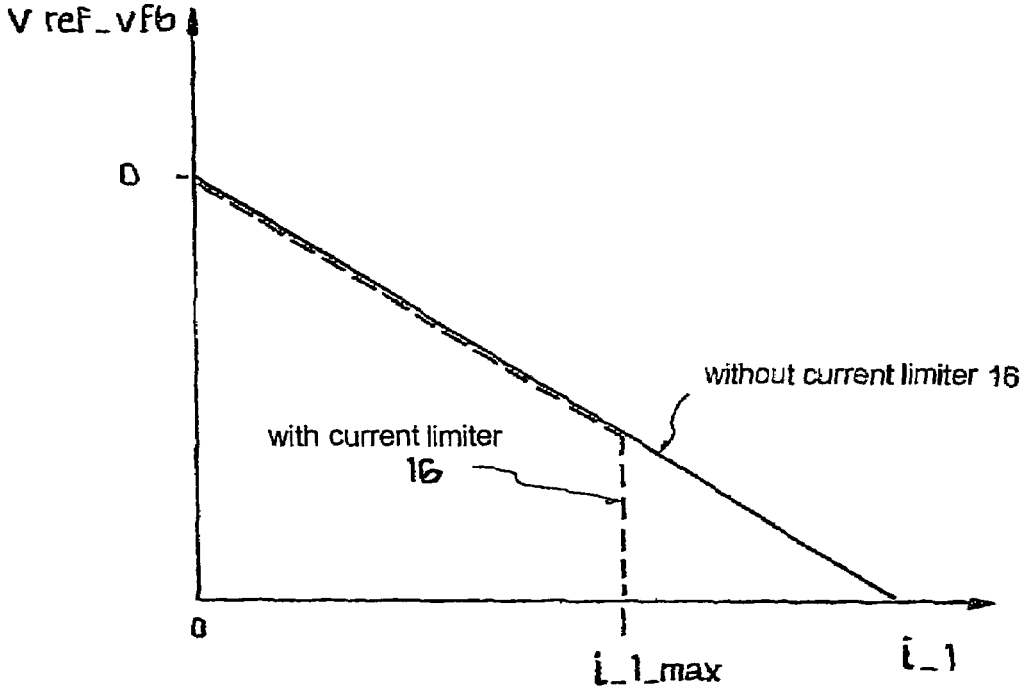
FIG. 4 illustrates a characteristic of a control current as a function of a differential control voltage in the constant voltage source.

FIG. 4 shows the current-limiting effect. Here, the solid line represents a dependence of the control current i_1 on the difference vref-vfb without limitation. The dashed line in contrast represents the corresponding course with a limitation to a maximum value I_1_max.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A constant voltage source comprising:

an output current control element for adjusting an output voltage of the constant voltage source by varying its output current;

a control circuit for acquiring a measure for an actual value of the output voltage and for processing the actual value to a control signal for the control of the output current control element; and a limiting circuit for limiting the output current to a predefined maximum value by acting on the control signal, the predefined maximum value being independent of the actual value of the output current;

wherein the limiting circuit has a first pair having a first transistor and a second transistor and a second pair comprising a third transistor and a fourth transistor, wherein the first transistor and the fourth transistor have a first conductivity type, and the second transistor and the third transistor have a second conductivity type, wherein operating current paths of the first pair are in series between a reference current source and a supply potential, wherein operating current paths of the second pair are integrated in series into the control branch, wherein control terminals of the first and fourth transistors and of the second and third transistors, respectively, are connected to one another, and wherein control terminals of the first and fourth transistors are connected to the reference current source, and control terminals of the second and third transistors are connected to a first voltage source.

2. The constant current source according to claim 1, further comprising a control current branch having an output current control element that includes a transistor diode that forms a current mirror with an output transistor, wherein a control current controlled by the control circuit flows as a control signal in the control current branch.

3. The constant voltage source according to claim 1, wherein the control circuit has a voltage divider, which is connected to the output current control element and has a center tap.

4. The constant current source according to claim 3, wherein the control circuit further comprises a differential amplifier with a first input and a second input, and wherein the first input is connected to a second voltage source and the second input is connected to the center tap.

5. The constant current source according to claim 4, wherein the control circuit has a fifth transistor, whose operating current path is integrated into the control branch and whose control terminal is connected to an output of the differential amplifier.

6. The constant current source according to claim 1, wherein the transistors and transistor diodes are realized using CMOS technology.

7. The constant current source according to claim 1, wherein the transistors of the first conductivity type are PMOS transistors and the transistors of the second conductivity type are NMOS transistors.

8. The constant voltage source according to claim 1, wherein the transistors and transistor diodes are realized using bipolar technology, and wherein the transistors of the first conductivity type are PNP transistors and the transistors of the second conductivity type are NPN transistors.

9. The constant current source according to claim 1, wherein the second transistor and the third transistor are high-blocking transistors.

10. A method for generating a load-independent constant output voltage with an output current control element, the method comprising:

adjusting the output voltage by varying an output current of the output current control element;

acquiring, via a control circuit, a measure for an actual value of the output voltage;

processing the actual value to a control signal for the control of the output current control element; and limiting, via a limiting circuit, the output current by limiting the control signal to a predefined maximum value, the control signal being formed independent of the actual value of the output current, wherein the limiting circuit has a first pair having a first transistor and a second transistor and a second pair comprising a third transistor and a fourth transistor, wherein the first transistor and the fourth transistor have a first conductivity type, and the second transistor and the third transistor have a second conductivity type, wherein operating current paths of the first pair are in series between a reference current source and a supply potential, wherein operating current paths of the second pair are integrated in series into the control branch, wherein control terminals of the first and fourth transistors and of the second and third transistors, respectively, are connected to one another, and wherein control terminals of the first and fourth transistors are connected to the reference current source, and control terminals of the second and third transistors are connected to a first voltage source.

* * * * *

UNITED STATES PATENT AND TRADEMARK OFFICE

CERTIFICATE OF CORRECTION

PATENT NO. : 7,358,713 B2
APPLICATION NO. : 11/637749
DATED : April 15, 2008
INVENTOR(S) : Clemens Hauser It is certified that error appears in the above-identified patent and that said Letters Patent is hereby corrected as shown below:

On the Title page, Item (30)
Change from:

(30) Foreign Application Priority Data: Dec. 13, 2005 (DE) 10 2006 061 377

To:

(30) Foreign Application Priority Data: Dec. 13, 2005 (DE) 10 2005 061 377

Signed and Sealed this

Nineteenth Day of August, 2008

JON W. DUDAS
*Director of the United States Patent and Trademark Office*